US010196225B2

(12) United States Patent
Ohtake et al.

(10) Patent No.: US 10,196,225 B2
(45) Date of Patent: Feb. 5, 2019

(54) DELIVERY ACCUMULATING APPARATUS

(71) Applicant: Kabushiki Kaisha Toshiba, Minato-ku (JP)

(72) Inventors: Masashi Ohtake, Kawasaki (JP); Hidenari Mori, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 15/623,999

(22) Filed: Jun. 15, 2017

(65) Prior Publication Data

US 2017/0362046 A1 Dec. 21, 2017

(30) Foreign Application Priority Data

Jun. 15, 2016 (JP) ..... 2016-119302

(51) Int. Cl.

| | |
|---|---|
| ***B65H 31/06*** | (2006.01) |
| ***B65H 29/22*** | (2006.01) |
| ***B07C 3/00*** | (2006.01) |
| ***B07C 3/08*** | (2006.01) |

(52) U.S. Cl.

CPC ..... *B65H 31/06* (2013.01); *B07C 3/008* (2013.01); *B07C 3/08* (2013.01); *B65H 29/22* (2013.01); *B65H 2301/321* (2013.01); *B65H 2301/42142* (2013.01); *B65H 2301/422548* (2013.01); *B65H 2405/11172* (2013.01)

(58) Field of Classification Search

CPC ..... B65H 29/14; B65H 29/42; B65H 29/48; B65H 31/26; B65H 2404/6112; B65H 2404/663; B65H 2404/691; B65H 2404/692; B65H 2404/693; B65H 2404/74; B65H 2404/741; B65H 2404/7414; B65H 31/06

See application file for complete search history.

(56) References Cited

U.S. PATENT DOCUMENTS

| | | | | |
|---|---|---|---|---|
| 5,347,790 A * | 9/1994 | Romanenko | ..... | B07C 3/008 414/790.3 |
| 5,452,985 A | 9/1995 | Roch et al. | | |
| 6,749,194 B2 * | 6/2004 | Hanson | ..... | B07C 3/008 271/176 |

FOREIGN PATENT DOCUMENTS

| | | |
|---|---|---|
| EP | 0 559 553 A1 | 9/1993 |
| FR | 2 680 121 A1 | 2/1993 |
| JP | 2012-240846 | 12/2012 |

OTHER PUBLICATIONS

European Search Report dated Oct. 18, 2017 in Patent Application No. 17 17 5649.

* cited by examiner

*Primary Examiner* — Michael C McCullough
(74) *Attorney, Agent, or Firm* — Oblon, McClelland, Maier & Neustadt, L.L.P.

(57) ABSTRACT

According to one embodiment, a delivery accumulating apparatus includes a collection base which is capable of accumulating a plurality of deliveries to be sequentially overlapped in a standing state in an accumulating direction on a surface thereof; an accumulating paddle which is capable of supporting a plurality of the deliveries accumulated on the collection base from an opposite direction of the accumulating direction, the accumulation paddle being arranged from above the collection base so that evacuation is possible; and an accommodation box which is arranged below the collection base, and is capable of accommodating a plurality of the deliveries.

10 Claims, 13 Drawing Sheets

DELIVERY ACCUMULATING APPARATUS

CROSS-REFERENCE TO RELATED APPLICATION

This application is based upon and claims the benefit of priority from the prior Japanese Patent Application No. 2016-119302, filed on Jun. 15, 2016; the entire contents of which are incorporated herein by reference.

FIELD

Embodiments described herein relate generally to a delivery accumulating apparatus.

BACKGROUND

Conventionally, a delivery accumulating apparatus of a standing position accumulating system which accumulates a plurality of deliveries in a standing state in piles is known. The delivery accumulating apparatus of the standing position accumulating system is provided with a collection base which accumulates a plurality of deliveries to be sequentially overlapped in a standing state in an accumulating direction, and an accumulating paddle which supports a plurality of the deliveries from an opposite direction of the accumulating direction. The delivery accumulating apparatus of the standing position accumulating system is suitable for accumulating relatively small and light deliveries such as a postcard. On the other hand, in the case of accumulating relatively large and heavy deliveries such as a large-sized envelope, a delivery accumulating apparatus of a chute system which chutes and accumulates the delivery in an accommodation box is suitable in miniaturization and simplification of the apparatus.

DETAILED DESCRIPTION

According to one embodiment, there is provided a delivery accumulating apparatus including: a collection base which is capable of accumulating a plurality of deliveries to be sequentially overlapped in a standing state in an accumulating direction on a surface thereof; an accumulating paddle which is capable of supporting a plurality of the deliveries accumulated on the collection base from an opposite direction of the accumulating direction, the accumulation paddle being arranged from above the collection base so that evacuation is possible; and an accommodation box which is arranged below the collection base, and is capable of accommodating a plurality of the deliveries; wherein the collection base is rotated and thereby evacuation is possible from above the accommodation box.

Hereinafter, delivery accumulating apparatuses according to embodiments will be described with reference to the drawings.

Figure 1:
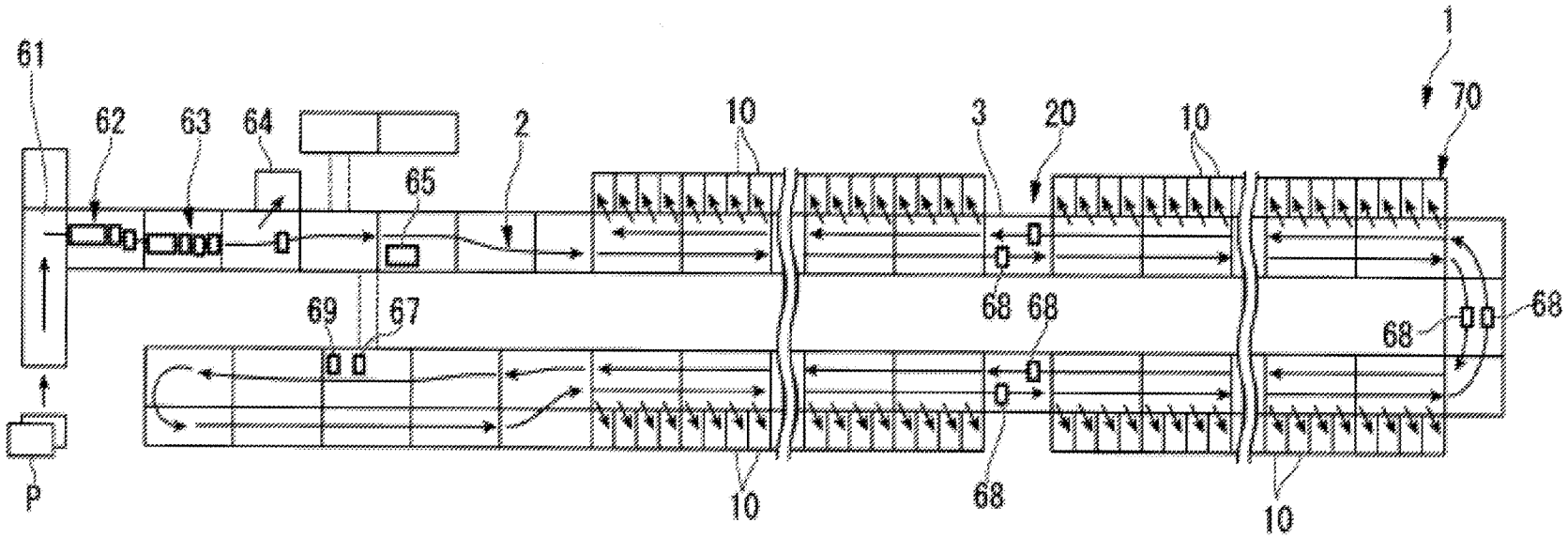
FIG. 1 is a plan view showing a configuration of a delivery handling apparatus provided with a delivery accumulating apparatus of a first embodiment.

(First Embodiment) A whole configuration of a delivery handling apparatus 1 provided with a delivery accumulating apparatus 10 of an embodiment will be described with reference to FIG. 1. FIG. 1 is a plan view showing an outline of a configuration of the delivery handling apparatus 1 of the embodiment. As shown in FIG. 1, the delivery handling apparatus 1 is an apparatus which recognizes a destination described or pasted on each of deliveries P such as a postcard and an envelope, and sorts and accumulates the deliveries P in the delivery accumulating apparatuses 10 corresponding to the destinations. The delivery handling apparatus 1 is a mail handling and sorting machine installed in a post office and so on, for example.

The delivery handling apparatus 1 is provided with a conveyor structure 20 and a sorting portion 70, for example. The sorting portion 70 has a plurality of the delivery accumulating apparatuses 10. The number of the delivery accumulating apparatuses 10 may be an optional number of two or more. The delivery accumulating apparatuses 10 are arranged along a conveying path 2 shown in FIG. 1.

As shown in FIG. 1, the conveyor structure 20 is proved with a supplier portion 61, an aligning portion 62, a conveyance propriety judging portion 63, a rejected delivery collection portion 64, a reader 65, an IJP (Ink Jet Printer) 67, gap correcting portions 68, and a conveyance table 3 having the conveying path 2, for example. In the supplier portion 61, a plurality of the deliveries P are taken out one by one. In the aligning portion 62, a position of the lower end of the delivery P is aligned, for example. In the conveyance propriety judging portion 63, a size, a posture, a plurality of overlapped sheets, existence or nonexistence of a foreign matter or metal, and so on of the delivery P are detected. When the size, the thickness or the like of the delivery P is out of standard, when a plurality of the deliveries P are in an overlapped state, when a foreign matter or the like is contained in the delivery P, and when the posture of the delivery P is out of standard, the delivery P like this is determined to be non-conveyable and is sent to the rejected delivery collection portion 64. The other delivery P passes through without change.

The reader 65 is provided with a camera (a line sensor) which images the delivery P. The reader 5 can read a bar code (a sorting bar code or the like) which is displayed on the delivery P. The reader 65 functions also as an OCR (Optical Character Recognition) processing portion. The OCR reads information such as a postal code, a destination, a sender and so on of the delivery P from an image imaged by the camera. The IJP 67 prints an object which is obtained by encoding the information of the delivery P acquired by the reader 65 on the delivery P, as a stealth bar code. The printed stealth bar code is read by a bar code reader 69 attached to the IJP 67, and is subjected to verifying processing. The gap correcting portion 68 adjusts a conveying speed of the delivery P, to correct a gap between a plurality of the deliveries P within a proper range. The conveying path 2 is provided on the upper surface of the conveyance table 3, and is a route for conveying the delivery P toward the delivery accumulating apparatus 10. While being conveyed along the conveying path 2, the deliveries P are accumulated in the respective delivery accumulating apparatuses 10 for each category such as a destination and a size.

Figure 4:
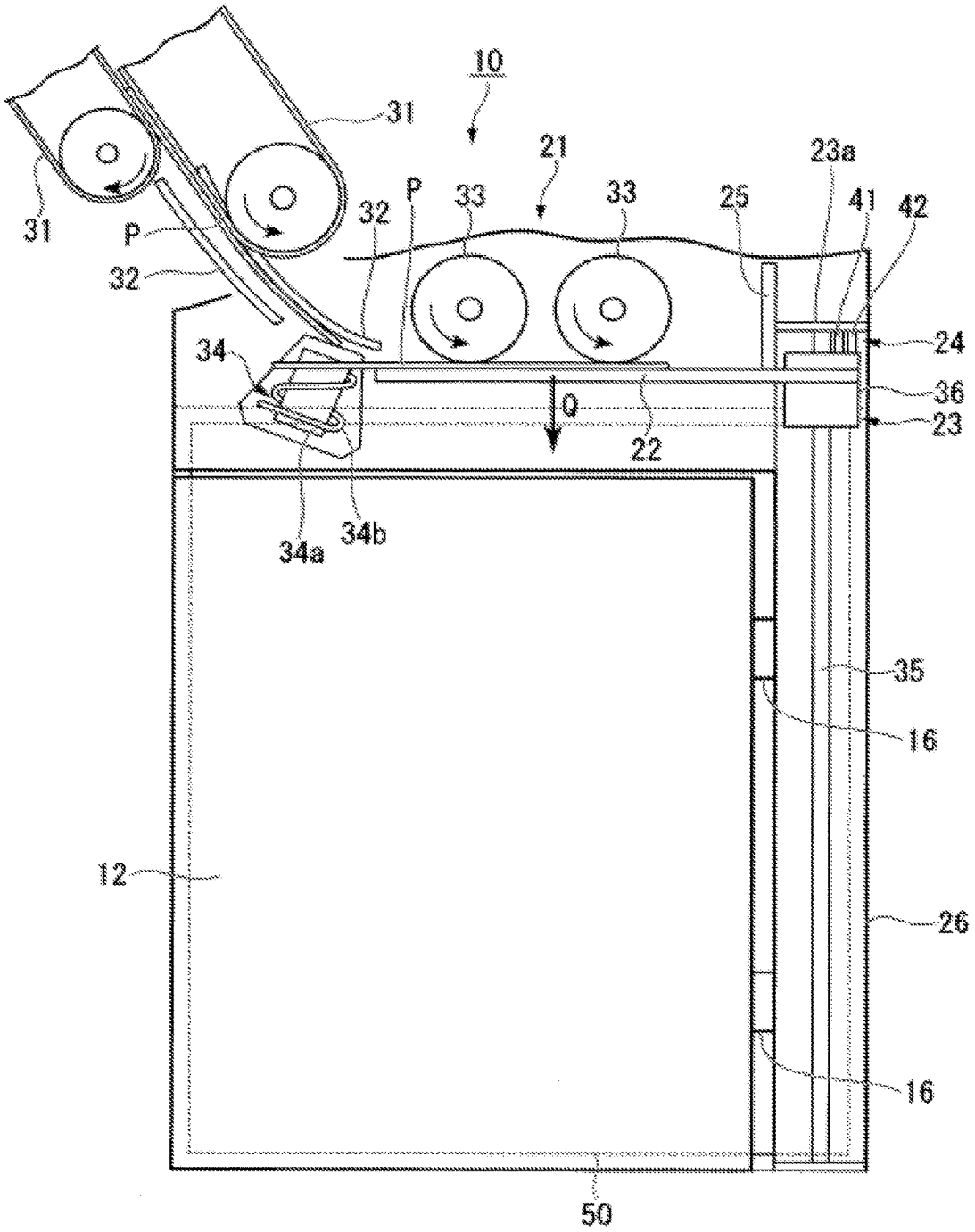
FIG. 4 is a plan view showing the configuration of the delivery accumulating apparatus of the first embodiment, and is the view showing a state in which the number of the accumulated deliveries is small.
Figure 5:
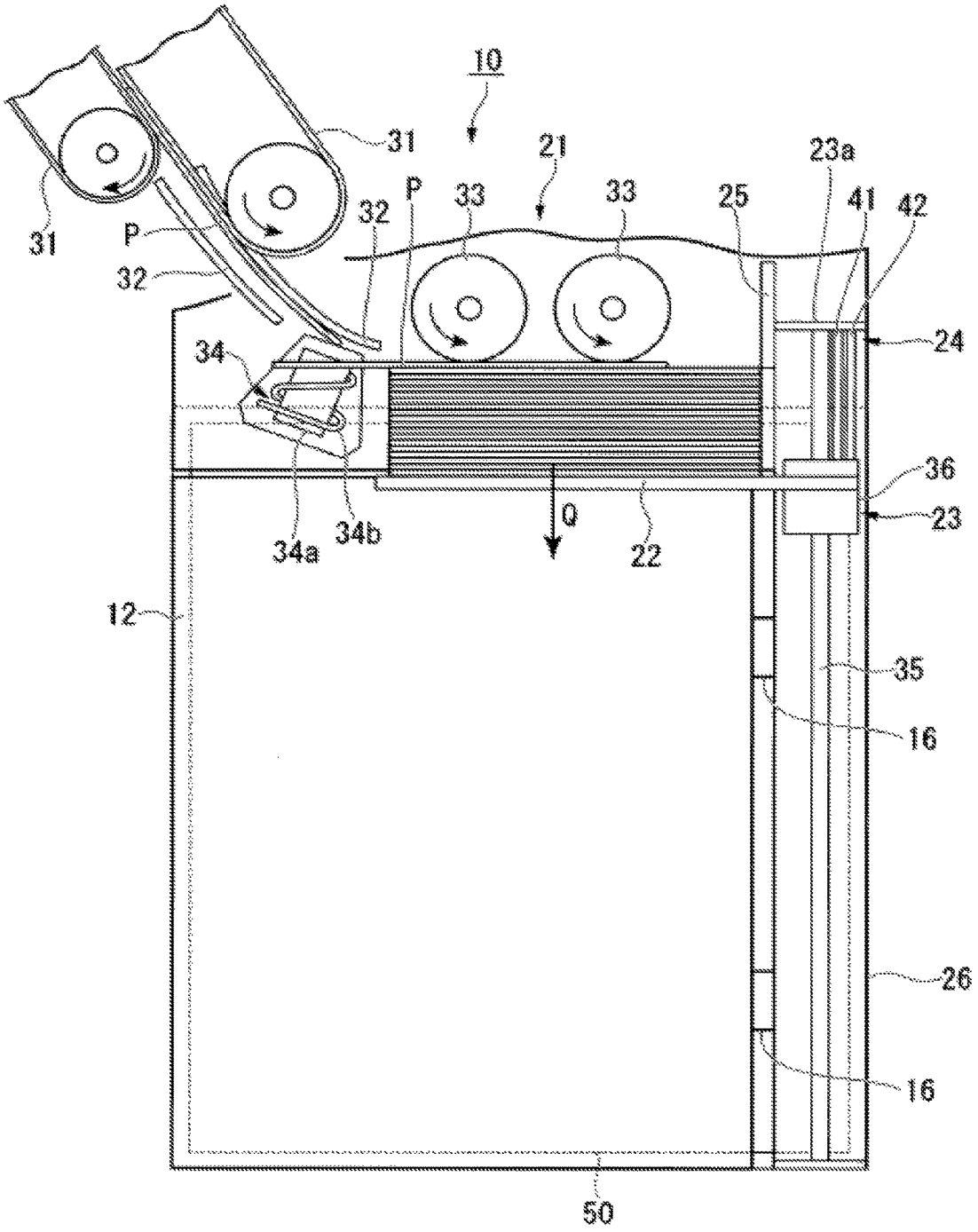
FIG. 5 is a plan view showing the configuration of the delivery accumulating apparatus of the first embodiment, and is the view showing a state in which the number of the accumulated deliveries is large.

Next, a configuration of the delivery accumulating apparatus 10 of the present embodiment will be described with reference to FIG. 2-FIG. 11. As shown in FIG. 2-FIG. 11, the delivery accumulating apparatus 10 is provided with a collection base 12, a compressing structure 21, an accumulating paddle 22, a paddle support structure 23, a bias structure 24, a stopper 25, an accommodation box 50. FIG. 4, FIG. 5 are plan views each showing the configuration of the delivery accumulating apparatus 10. Out of these, FIG. 4 shows a state in which the number of the accumulated deliveries P is small, and FIG. 5 shows a state in which the number of the accumulated deliveries P is large. As shown in FIG. 4, FIG. 5, the delivery accumulating apparatus 10 can sequentially accumulate a plurality of the deliveries P in a standing state in piles on the surface of the collection base 12 in an accumulating direction Q.

Here, in the present embodiment, a downstream side along the accumulating direction Q is called a front side, and the opposite side thereof is called a back side. In addition, a direction orthogonal to a vertical direction and the accumulating direction Q is called a horizontal direction. A compressing roller pair 33 described later of the compressing structure 21 and the stopper 25 are opposite to each other in the horizontal direction. Along the horizontal direction, the stopper 25 side is called a right side, and the compressing roller pair 33 side is called a left side.

As shown in FIG. 4, the compressing structure 21 is provided with a conveyor belt pair 31, a conveyance guide pair 32, the compressing roller pair 33, and a transmitting screw 34. In addition, in the perspective views shown in FIGS. 2, 3, 6 and 8-10, the description of the conveyor belt pair 31 is omitted so that the drawings can be seen easily. As shown in FIG. 4, the conveyor belt pair 31 conveys the delivery P toward the transmitting screw 34. The conveyance guide pair 32 extends from the conveyor belt pair 31 to the transmitting screw 34. The conveyance guide pair 32 guides the delivery P from the conveyor belt pair 31 toward the transmitting screw 34. The transmitting screw 34 has a blade portion 34*b* which is spirally provided on the outer circumferential surface of a columnar shaft portion 34*a*. The compressing roller pair 33 is arranged at the right side from the transmitting screw 34. The compressing roller pair 33 are arranged side by side in the horizontal direction. The compressing roller pair 33 is arranged opposite to the accumulating paddle 22 in the accumulating direction Q. The conveyor belt pair 31, the compressing roller pair 33, and the transmitting screw 34 are rotation-driven by a driving force such as a motor (not shown).

The transmitting screw 34 conveys the delivery P in such a manner as to compress it between the compressing roller pair 33 and the accumulating paddle 22, by the blade portion 34*b* rotating around a shaft of the shaft portion 34*a*. The compressing roller pair 33 conveys the delivery P which has been conveyed by the transmitting screw 34 toward the stopper 25. The delivery P is abutted to the stopper 25, and thereby the position thereof in the horizontal direction is regulated. The accumulating roller pair 33 sequentially accumulates a plurality of the deliveries P in piles in the accumulating direction Q.

Figure 2:
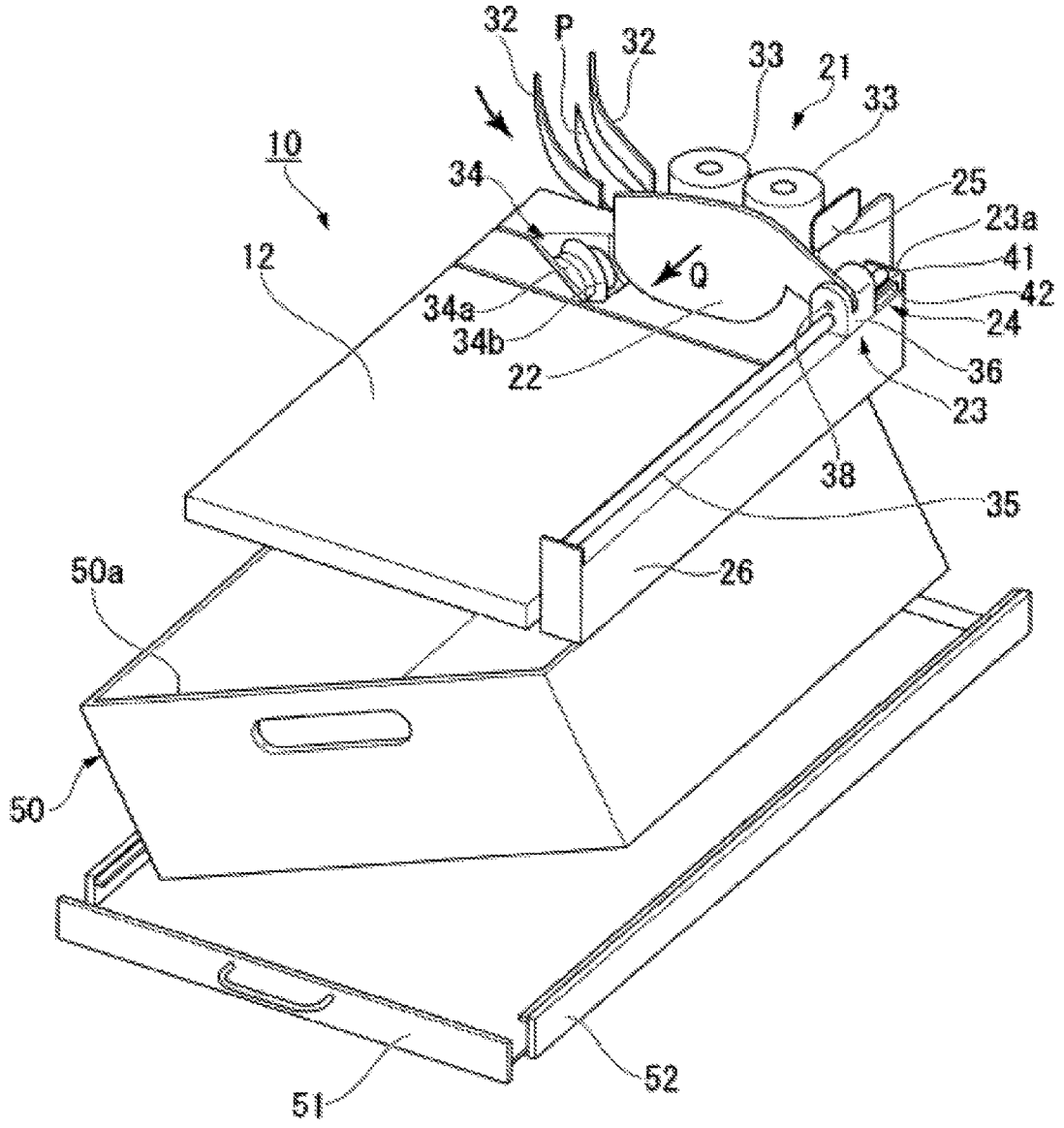
FIG. 2 is a perspective view showing a configuration of the delivery accumulating apparatus of the first embodiment.
Figure 3:
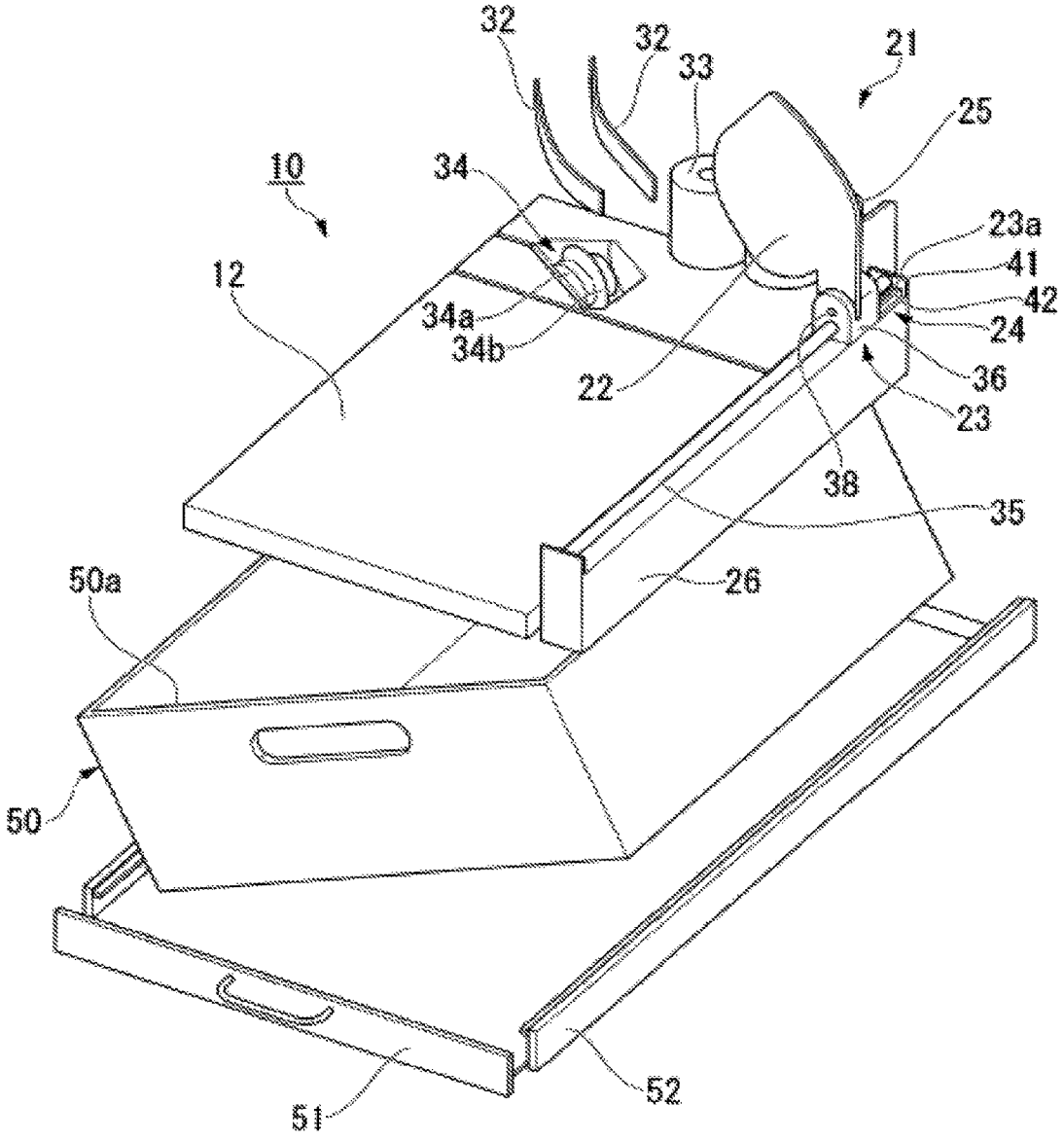
FIG. 3 is a perspective view showing the configuration of the delivery accumulating apparatus of the first embodiment, and is the view showing a state in which the accumulating paddle has been rotated.

As shown in FIG. 2, the accumulating paddle 22 is coupled to the paddle support structure 23. The paddle support structure 23 is provided with a paddle support wall 26, a slider shaft 35, a slider 36. The paddle support wall 26 extends in parallel with the accumulating direction Q, and also extends along the vertical direction. The slider shaft 35 is fixed to the paddle support wall 26, and extends in parallel with the accumulating direction Q. The slider 36 slidably moves in parallel with the accumulating direction Q along the slider shaft 35. The accumulating paddle 22 is fixed to the slider 36. The accumulating paddle 22 slidably moves in parallel with the accumulating direction Q along with the slider 36. In addition, in the example shown in the drawings, the round rod shaped slider shaft 35 has been used, but the movement of the accumulating paddle 22 in the accumulating direction Q may be guided by other configuration. For example, a slide rail extending in parallel with the accumulating direction Q may be used. Or, a bearing or the like fixed to the accumulating paddle 22 may be abutted to a guide wall extending in parallel with the accumulating direction Q, to guide the movement of the accumulating paddle 22 in the accumulating direction Q.

As shown in FIG. 2 and so on, the slider 36 is provided with a rotating shaft 38. The rotating shaft 38 extends in parallel with the accumulating direction Q. The rotating shaft 38 is arranged inside the slider 36 and also above the slider shaft 35. The rotating shaft 38 is inserted into a through hole which is formed in the accumulating paddle 22 and extends in parallel with the accumulating direction Q. By this means, the accumulating paddle 22 is rotatable around the rotating shaft 38. When the accumulating paddle 22 is rotated around the rotating shaft 38, the accumulating paddle 22 is abutted to an abutting portion not shown, and becomes in a state shown in FIG. 3. By this means, the accumulating paddle 22 can be evacuated from above the collection base 12.

As shown in FIG. 2 and so on, the bias structure 24 is provided between an end portion 23*a* of the paddle support structure 23 and the slider 36. The bias structure 24 is provided with a spring 41 and a spring 42. The springs 41 and 42 are provided so that elongation of the springs increases, in accordance with that the slider 36 moves in parallel with the accumulating direction Q, for example. The spring 41 and the spring 42 are connected between the end portion 23*a* of the paddle support structure 23 and the slider 36. The spring 41 and the spring 42 give the slider 36 biasing forces toward an opposite direction of the accumulating direction Q by return forces of the springs. The spring 41 and the spring 42 energize the accumulating paddle 22 in an opposite direction of the accumulating direction Q via the slider 36. The accumulating paddle 22 can support a plurality of the deliveries P to be sequentially overlapped in a standing state in the accumulating direction Q, from an opposite direction of the accumulating direction Q, by the return forces of the spring 41 and the spring 42. When the number of the accumulated deliveries P to be sequentially overlapped in the accumulating direction Q by the compressing structure 21 increases, the accumulating paddle 22 slidably moves in parallel with the accumulating direction Q along with the slider 36, while supporting the plurality of deliveries P by the biasing forces changing in an increasing trend.

Figure 6:
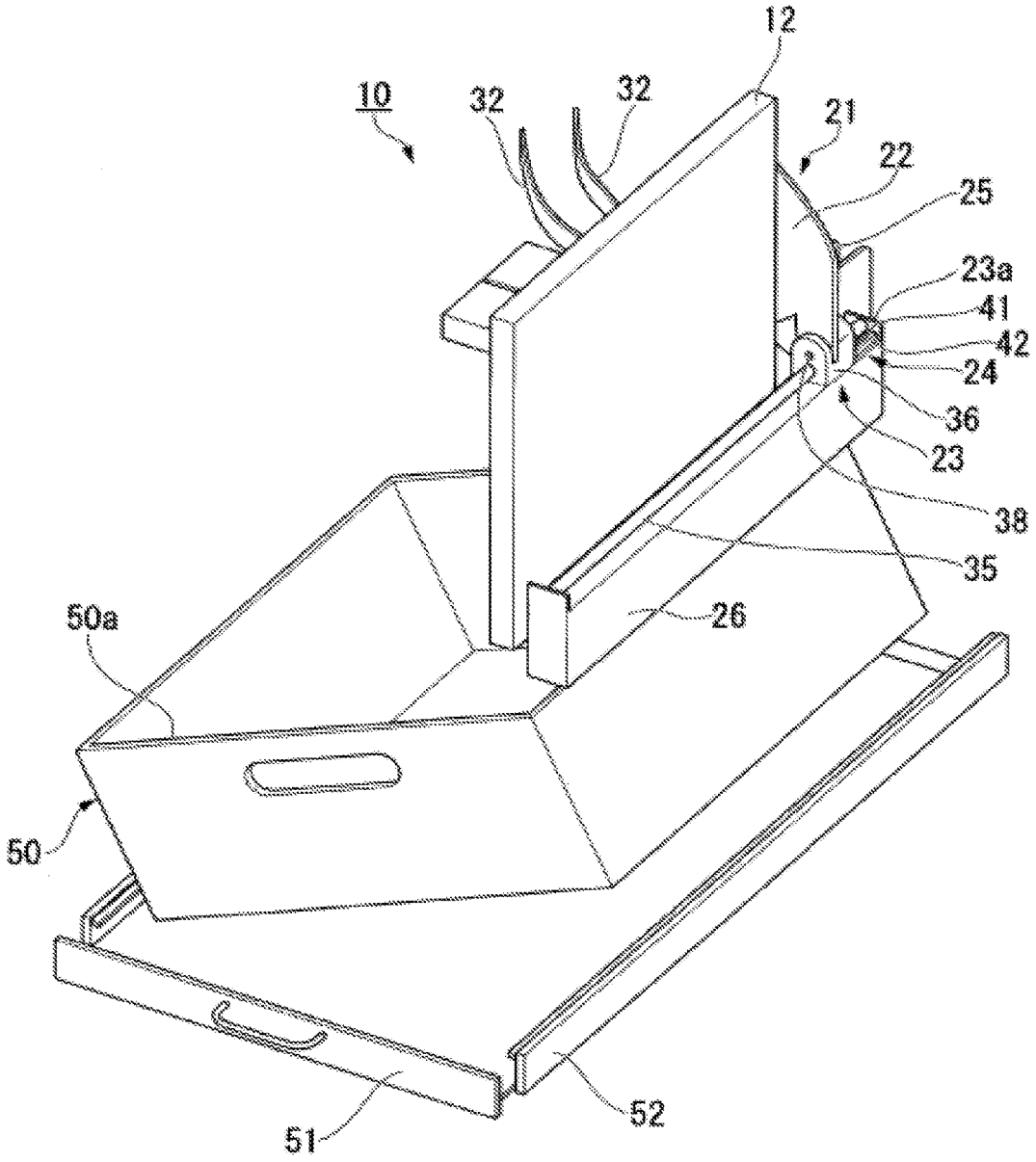
FIG. 6 is a perspective view showing the configuration of the delivery accumulating apparatus of the first embodiment, and is the view showing a state in which the collection base has been rotated.
Figure 7:
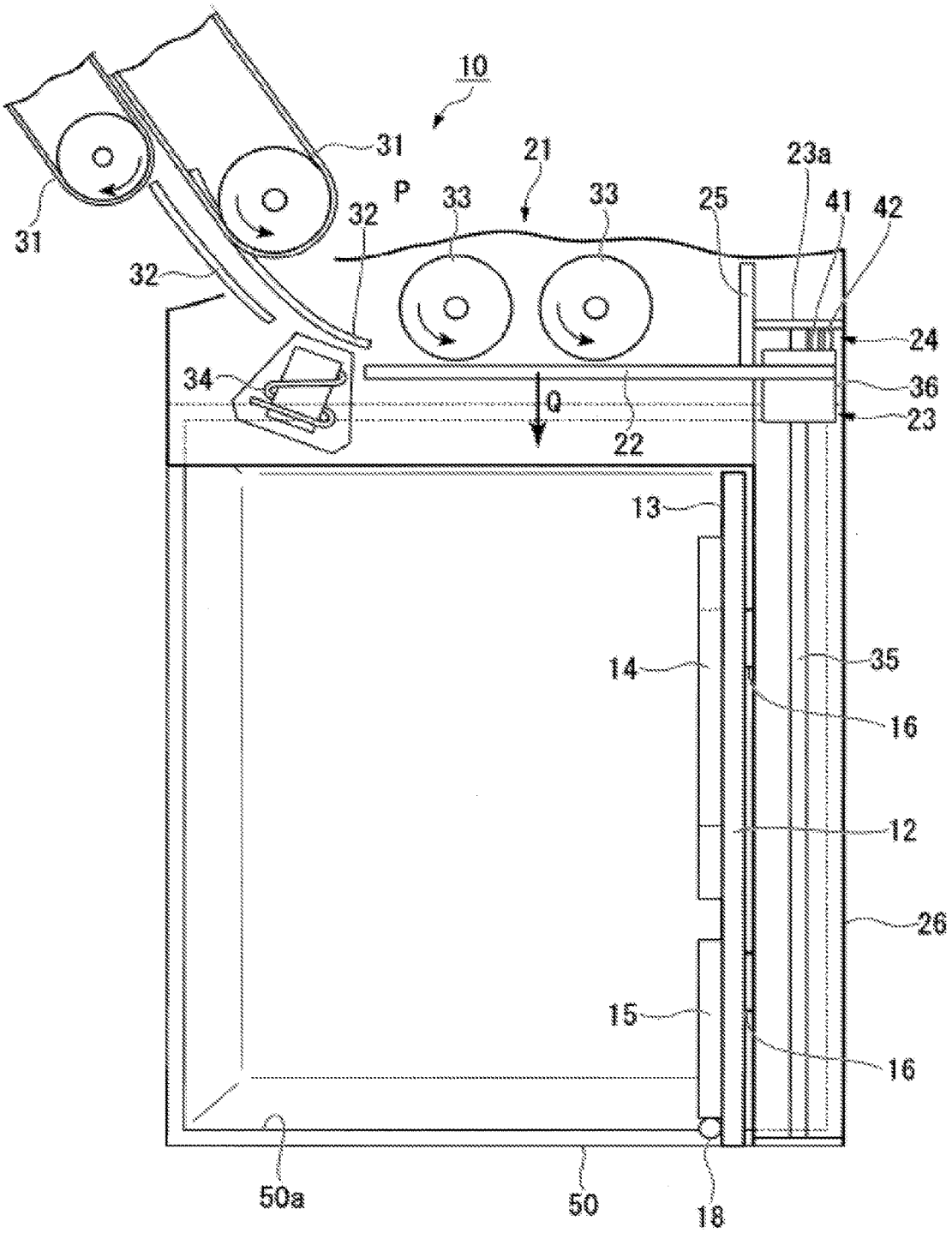
FIG. 7 is a plan view showing the configuration of the delivery accumulating apparatus of the first embodiment, and is the view showing a state in which the collection base has been rotated.

As shown in FIG. 2, the collection base 12 is formed in a rectangular plate shape. The collection base 12 extends along the accumulating direction Q and the horizontal direction. The collection base 12 is arranged above the accommodation box 50. The collection base 12 covers an opening portion 50*a* of the accommodation box 50 at a position above and distant from the opening portion 50*a*. As shown in FIG. 4, the collection base 12 is rotatably coupled to the paddle support wall 26 by means of first hinges 16. FIG. 6 is a perspective view showing the configuration of the delivery accumulating apparatus 10, and shows a state in which the collection base 12 has been rotated. FIG. 7 is a plan view showing the configuration of the delivery accumulating apparatus 10, and shows a state in which the collection base 12 has been rotated. When the collection base 12 is rotated around the first hinges 16, the collection base 12 is held in an erected state with respect to the horizontal plane, as shown in FIG. 6, FIG. 7. By this means, the collection base 12 is evacuated from above the accumulation box 50. The collection base 12 is evacuated from above the accommodation box 50, and thereby the opening portion 50*a* of the accommodation box 50 is exposed in a top view.

As shown in FIG. 7, a first guide 13, a second guide 14, and a third guide 15 are arranged on the rear surface side of the collection base 12. In the present embodiment, the rear surface of the collection base 12 functions as the first guide 13. In addition, the collection base 12 and the first guide 13 may be formed separately.

Figure 8:
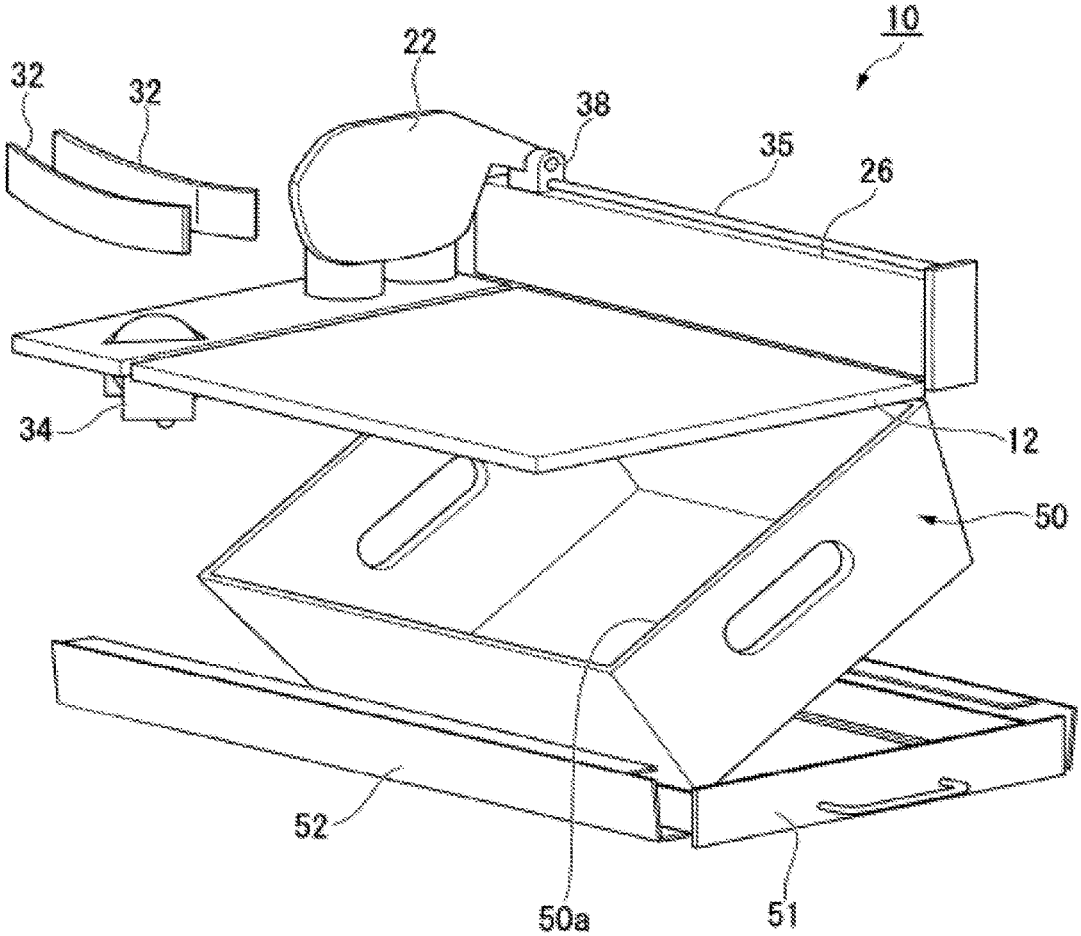
FIG. 8 is a perspective view showing the configuration of the delivery accumulating apparatus of the first embodiment.
Figure 9:
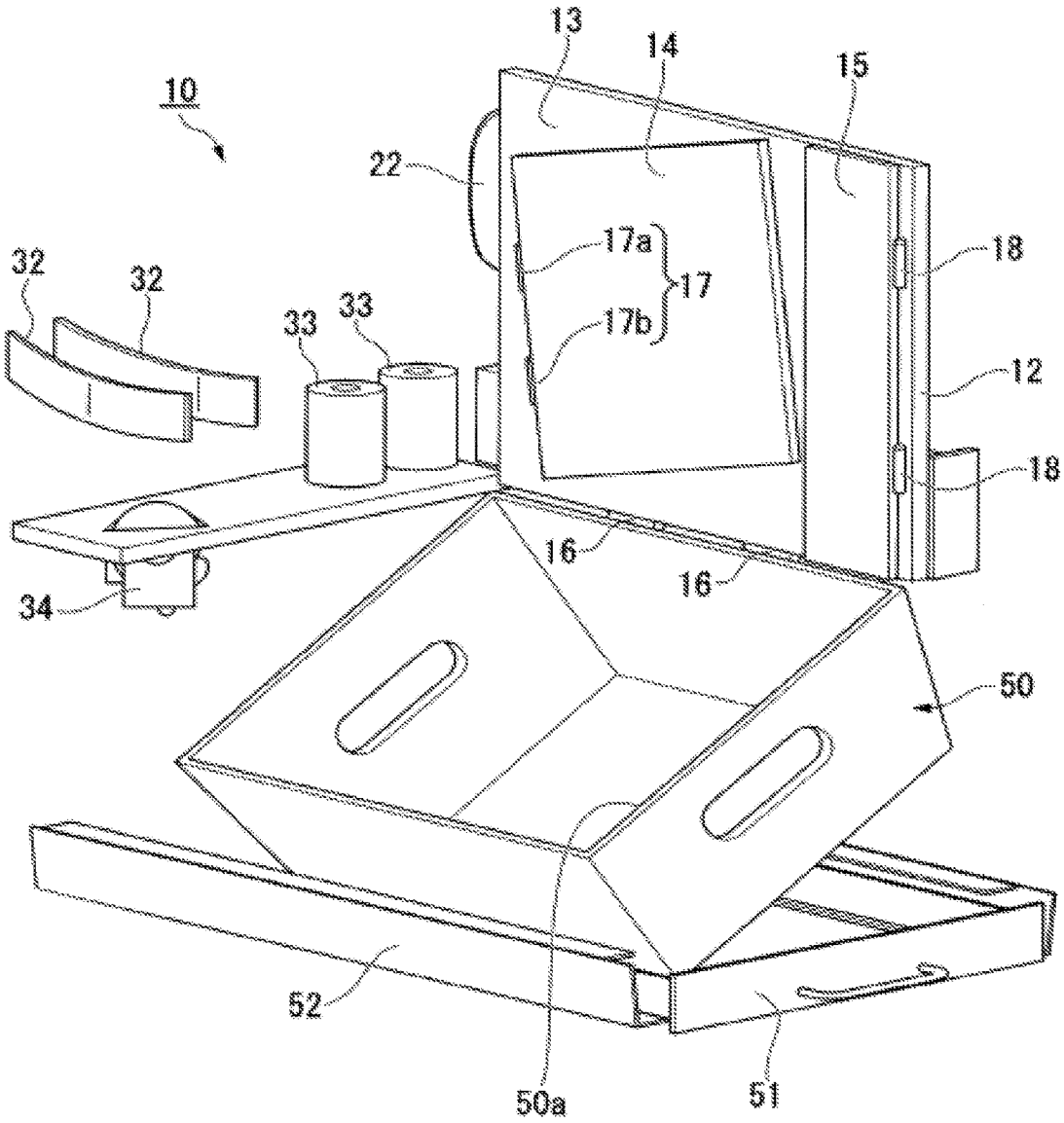
FIG. 9 is a perspective view showing the configuration of the delivery accumulating apparatus of the first embodiment, and is the view showing a state in which the collection base has been rotated.
Figure 10:
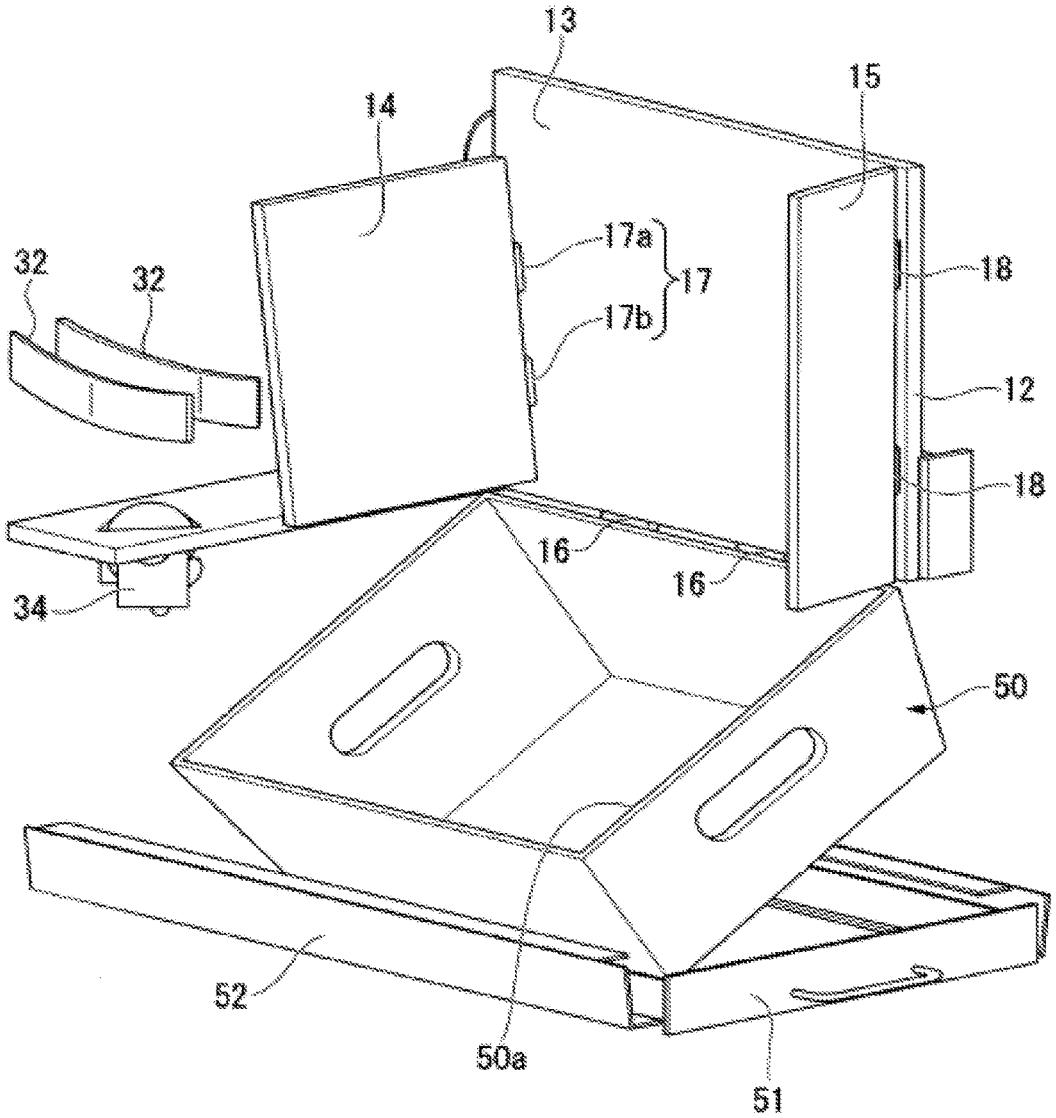
FIG. 10 is a perspective view showing the configuration of the delivery accumulating apparatus of the first embodiment, and is the view showing a state in which the collection base, the second guide, and the third guide have been rotated.

FIG. 8-FIG. 10 are perspective views each showing the configuration of the delivery accumulating apparatus 10. As shown in FIG. 9, the second guide 14 is formed in a rectangular plate shape. The second guide 14 is coupled to the rear surface of the collection base 12, via a pair of second hinges 17*a* and 17*b*. The second guide 14 is held in a state to be in approximately parallel with the collection base 12. As a pair of the second hinges 17*a* and 17*b*, a pair of torque hinges may be used, for example. When the torque hinges are used, it becomes possible to hold the second guide 14 in a state to be in approximately parallel with the collection base 12, and also it becomes possible to rotate the second guide 14 with respect to the collection base 12. In addition, usual hinges may be used as a pair of the second hinges 17*a* and 17*b*, to hold the posture of the second guide 14 by a stopper or the like.

Figure 11:
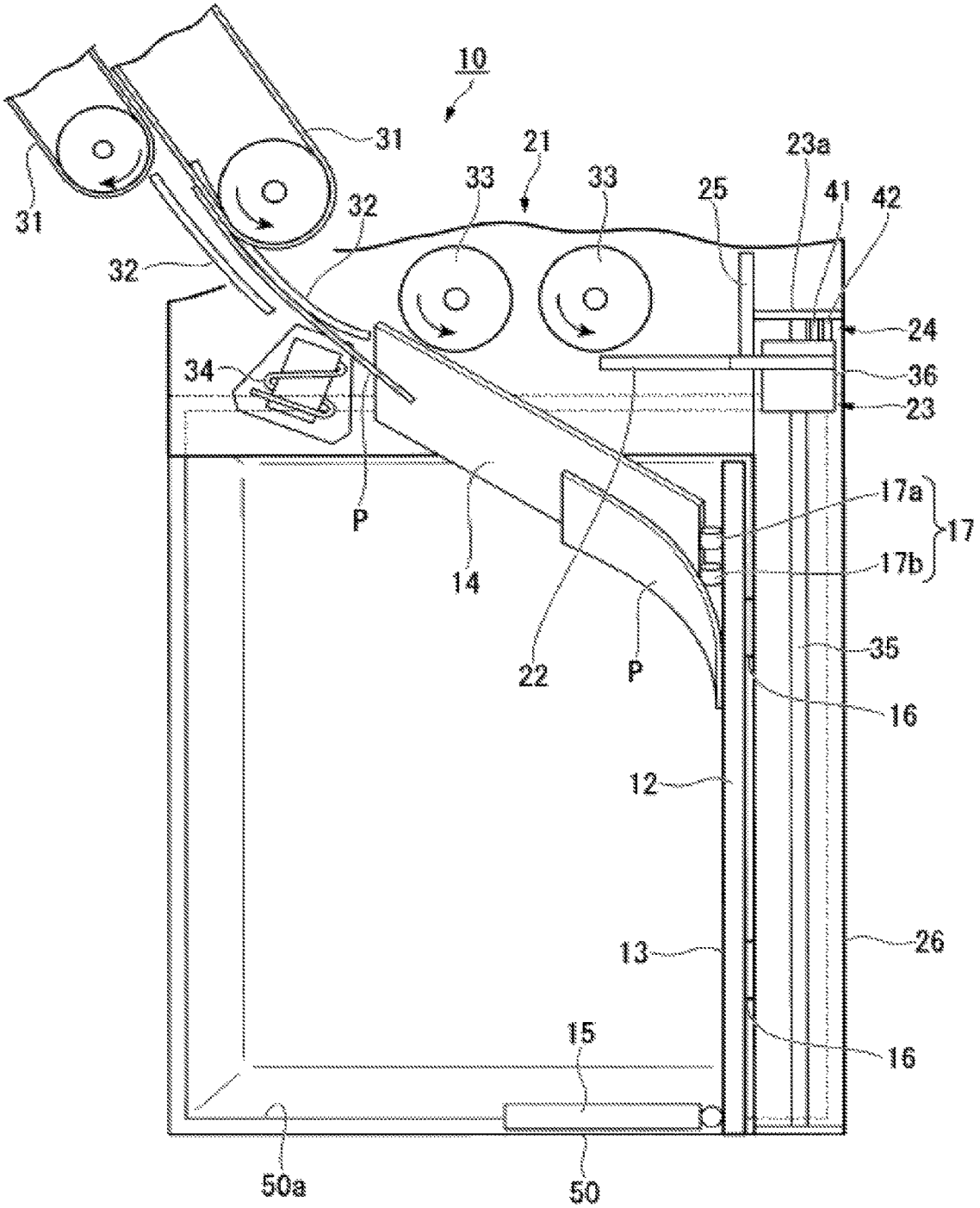
FIG. 11 is a plan view showing the configuration of the delivery accumulating apparatus of the first embodiment, and the view showing a state in which the collection base, the second guide, and the third guide have been rotated.

The second guide 14 is rotatable around a pair of the second hinges 17*a* and 17*b*. The respective second hinges 17*a* and 17*b* of the pair are arranged at different positions with each other in the accumulating direction Q. In detail, in the state in which the collection base 12 is erected as shown in FIG. 9, the second hinge 17*b* at the lower side is arranged at a more front side than the second hinge 17*a* at the upper side. For this reason, a rotation axis of the second guide 14 is tilted with respect to the vertical direction, so that as the rotation axis goes downward, it gradually goes toward the accumulating direction Q. In addition, a pair of the second hinges 17*a* and 17*b* is arranged in the vicinity of the circumferential wall at the back side of the accommodation box 50 in the accumulating direction Q. By this means, the rotation axis of the second guide 14 is tilted with respect to the vertical direction, so that as the rotation axis goes downward, it gradually goes from the outside toward the inside of the accumulating box 50. Accordingly, when the second guide 14 is rotated around a pair of the second hinges 17*a* and 17*b*, the second guide 14 becomes in a state that as it goes downward, it gradually extends from the outside toward the inside of the accumulation box 50, as shown in FIG. 10 and FIG. 11. With the configuration described above, the second guide is rotatably arranged in a state in which the second guide 14 is erected on the first guide 13. The second guide 14 is arranged at a more back side (an upstream side in the accumulating direction Q) than the first guide 13. As shown in FIG. 11, an end portion of back side of the second guide 14 is held in a state to be adjacent to end portions of the front side of the conveyance guide pair 32.

As shown in FIG. 9, the third guide 15 is formed in a rectangular plate shape. The third guide 15 is coupled to the rear surface of the collection base 12 via a pair of third hinges 18. The third guide 15 is held in a state to be in approximately parallel with the collection base 12. As the third hinge 18, a torque hinge may be used, for example. When the torque hinges are used, it becomes possible to hold the third guide 15 in a state to be in approximately parallel with the collection base 12, and also it becomes possible to rotate the third guide 15 with respect to the collection base 12. In addition, usual hinges may be used as the third hinges 18, to hold the posture of the third guide 15 by a stopper or the like. The third guide 15 is rotatable around a pair of the third hinges 18. When rotated around a pair of the third hinges 18, the third guide 15 becomes in a state to be extended along the horizontal direction, as shown in FIG. 10, FIG. 11. The third guide 15 is arranged rotatably in a state to be erected on the first guide 13. The third guide 15 is held in a state to extend along the horizontal direction. The third guide 15 is arranged at a more front side (a downstream side in the accumulating direction Q) than the first guide 13.

As shown in FIG. 2 and so on, the accommodation box 50 is arranged below the collection base 12. The accommodation box 50 can accommodate a plurality of the deliveries P. A drawer try 51 is arranged below the accommodation box 50. The drawer tray 51 is movable in parallel with the accumulating direction Q with respect to the collection base 12. The accommodation box 50 is fixed to the drawer tray 51 in a state to be tilted with respect to the horizontal plane. As shown in FIG. 9, an upper end portion of the accommodation box 50 is close to the first hinges 16. For this reason, when the collection base 12 is rotated around the first hinges 16, a lower end portion of the collection base 12 becomes close to the upper end portion of the accommodation box 50. The bottom portion of the accommodation box 50 gradually extends downward as it goes leftward. The drawer tray 51 is movably supported in parallel with the accumulating direction Q by means of a support portion 52.

Hereinafter, an operation of the delivery accumulating apparatus 10 of the embodiment will be described. When the surface of the collection base 12 is in a horizontal state as shown in FIG. 2, the delivery accumulating apparatus 10 comes to use a standing position accumulating system which sequentially overlaps the deliveries P in a standing state in the accumulating direction Q. In the standing position accumulating system, the compressing structure 21 sequentially accumulates the deliveries P between the compressing roller pair 33 and the accumulating paddle 22. At this time, as shown in FIG. 4, FIG. 5, as the deliveries P have been accumulated, the accumulating paddle 22 sequentially moves in the accumulating direction Q. After a prescribed amount of the deliveries P have been accumulated, the drawer tray 51 is drawn to the front side along with the accommodation box 50. Next, the accumulating paddle 22 is rotated around the rotating shaft 38, and thereby is evacuated from on the collection base 12. And the accumulated deliveries P are moved to the front side, and are dropped from the collection base 12 into the accommodation box 50, and thereby it is possible to easily accommodate the deliveries P into the accommodation box 50.

Next, a case in which a system of the delivery accumulating apparatus 10 is changed to a chute system will be described. In the chute system, the delivery P which has been conveyed by the conveyor belt pair 31 is directly chuted into the accommodation box 50. In order to change a system of the delivery accumulating apparatus 10 from the standing position accumulating system to the chute system, to begin with, the accumulating paddle 22 is rotated around the rotating shaft 38, and thereby is evacuated from on the collection base 12 (refer to FIG. 2, FIG. 3). Next, the collection base 11 is rotated around the first hinges 16, and thereby is evacuated from above the accommodation box 50 (refer to FIG. 8, FIG. 9). Next, the second guide 14 is rotated around a pair of the second hinges 17*a* and 17*b*, and the third guide 15 is rotated around the third hinges 18 (refer to FIG. 10). In this state, the conveyor belt pair 31 is driven, to make the delivery P to be conveyed (hereinafter, refer to FIG. 11). When the delivery P goes out of the conveyor belt pair 31, it proceeds while being guided by the conveyance guide pair 32, and comes into contact with the second guide 14. After the delivery P has been released from the conveyor belt pair 31, the delivery P also proceeds to some extent by inertia. At this time, the delivery P gradually drops, and proceeds while slidably contacting with the second guide 14 and the first guide 13. And the delivery P comes in contact with the third guide 15, and drops within the accommodation box 50. Since the bottom portion of the accommodation box 50 is tilted, the delivery P which has dropped in the accommodation box 50 is sequentially moved to the left side. As described above, according to the chute system, the deliveries P drop sequentially into the accommodation box 50, and are directly accumulated in the accommodation box 50.

In the case of accumulating relatively small and light deliveries P such as a postcard, for example, a standing position accumulating system which can accumulate the deliveries P at high speed and in high density is suitable. On the other hand, in the case of accumulating relatively large-sized and heavy deliveries P such as a large-sized envelope by the standing position accumulating system, for example, it is necessary to make the respective parts of the delivery accumulating apparatus 10 large-sized and robust, to cause upsizing and cost increasing of the apparatus. Accordingly, in the case of accumulating large-sized deliveries P like this, a chute system which directly chutes the delivery P in the accommodation box 50 is suitable.

According to the embodiment described above, since the collection base 12 is rotated and thereby can be evacuated from above the accommodation box 50, the standing position accumulating system and the chute system can easily be switched. By this means, it is possible to provide the delivery accumulating apparatus 10 which can switch the accumulation systems in accordance with the kind of the deliveries P.

In addition, since the first guide 13, the second guide 14, and the third guide 15 are formed on the rear surface side of the collection base 12, when the chute system is used by rotating the collection base 12, these guides emerge, and can surely lead the delivery P into the accommodation box 50. In detail, the second guide 14 arranged at the upstream side from the first guide 13 in the accumulating direction Q leads the delivery P which has gone out of the conveyance guide pair 32 to the first guide 13. The first guide 13 leads the delivery P to the third guide 15. Since the third guide 15 which is arranged at the downstream side from the first guide 13 in the accumulating direction Q is held in a state in which the third guide 15 stands on the first guide 13, the delivery P comes in contact with the third guide 15 and thereby is decelerated. By this means, the delivery P drops into the accommodation box 50.

In addition, the second guide 14 and the third guide 15 are held in a state to be in approximately parallel with the collection base 12, and thereby the whole of the delivery accumulating apparatus 10 can be made compact. In addition, it can be prevented that, in the case of the standing position accumulating system, the second guide 14 and the third guide 15 project downward from the collection base 12, to block the movement of the accommodation box 50 in the accumulating direction Q.

In addition, even if the delivery P to be guided by the second guide 14 has dropped before coming in contact with the first guide 13, the second guide 14 is gradually tilted so that as it goes downward, it goes from the outside toward the inside of the accommodation box 50, and accordingly it is possible to lay down the posture of the dropped delivery P with respect to the horizontal plane. By this means, it is suppressed that the delivery P becomes in an erected state in the accommodation box 50, and thereby it is possible to accumulate a plurality of the deliveries P in a state to be in parallel with the bottom portion of the accommodation box 50.

(Second embodiment) A second embodiment is different from the first embodiment in a point that the collection base 12 is rotatable beyond an erection posture thereof. In the second embodiment, only points which are different from the first embodiment will be described.

Figure 12:
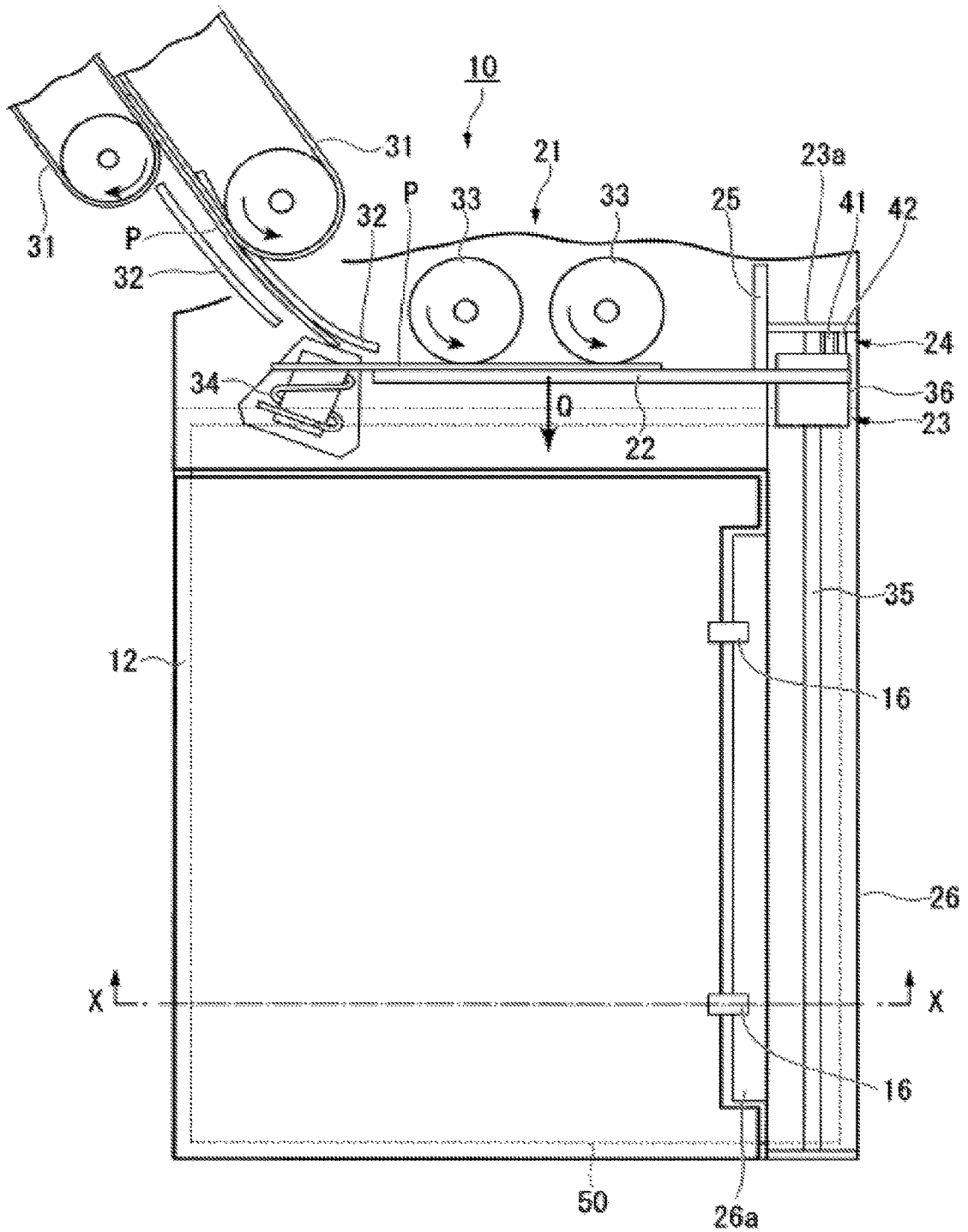
FIG. 12 is a plan view showing a configuration of a delivery accumulating apparatus of a second embodiment.
Figure 13:
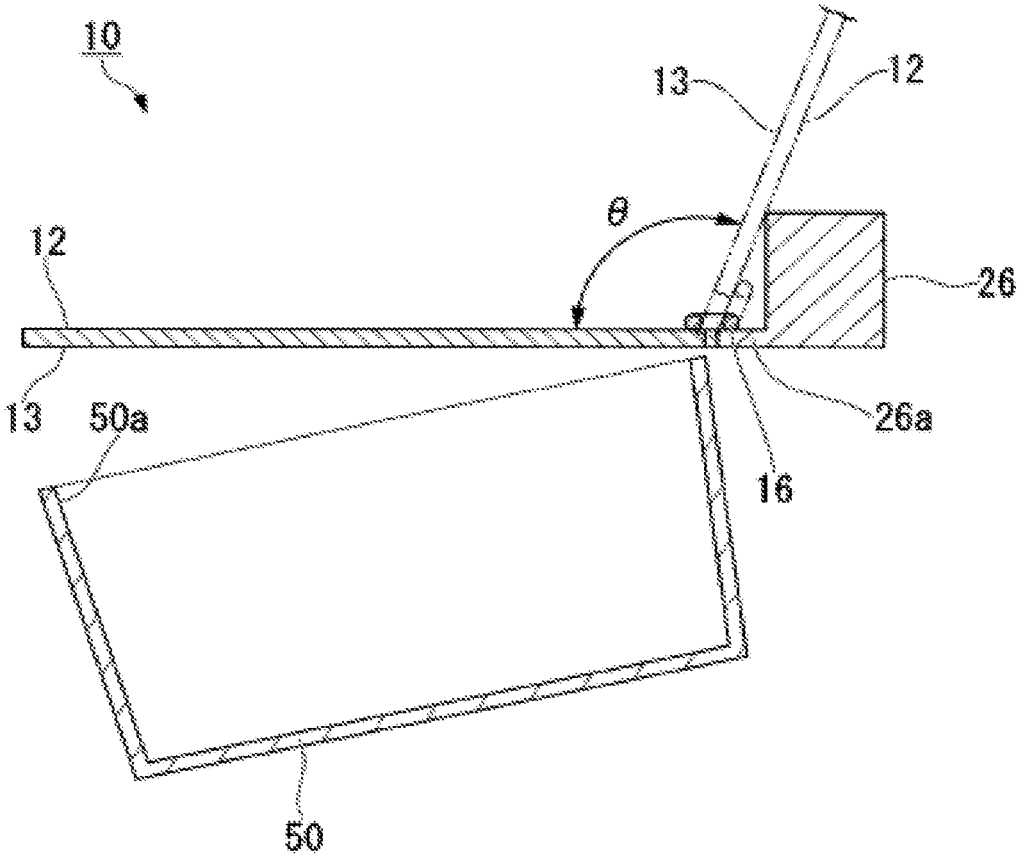
FIG. 13 is a sectional view seen from an arrow direction X-X of the delivery accumulating apparatus of the second embodiment shown in FIG. 12.

As shown in FIG. 12 and FIG. 13, in the second embodiment, a projecting portion 26*a* which projects from the lower end portion toward the left side is formed on the paddle support wall 26. By this means, the paddle support wall 26 is formed in an L-shape in a front view seen from the front side. And, the first hinges 16 are arranged on tip portions of the projecting portion 26*a*. By this means, the collection base 12 becomes rotatable beyond 90°, as shown in FIG. 13. When the collection base 12 is rotated around the first hinges 16, the surface of the collection base 12 comes in contact with the paddle support wall 26. By this means, the first guide 13 is held in a state that, in a front view seen from the front side (an opposite direction of the accumulating direction Q), as the first guide 13 goes downward, it gradually extends from the outside toward the inside of the accommodation box 50. A rotation angle θ of the collection base 12 at this time is 100°-120°, for example.

According to the second embodiment described above, since the first guide 13 is tilted from the outside toward the inside of the accommodation box 50, it is possible to lay down the posture of the delivery P which slidably contacts with the first guide 13. By this means, it is suppressed that the dropped delivery P becomes in an erected state in the accommodation box 50, and thereby it is possible to accumulate a plurality of deliveries P in a state to be in parallel with the bottom portion of the accommodation box 50.

According to at least one embodiment described above, since the collection base 12 is rotated, and thereby evacuation is possible from above the accommodation box 50, it is possible to easily switch the standing position accumulating system and the chute system. By this means, it is possible to provide the delivery accumulating apparatus 10 which can switch the accumulation systems in accordance with the kind of the delivery P.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A delivery accumulating apparatus comprising:

a collection base which is capable of accumulating a plurality of deliveries to be sequentially overlapped in a standing state in an accumulating direction on a surface thereof, the collection base is rotated and thereby evacuation is possible from above an accommodation box;

an accumulating paddle which is capable of supporting a plurality of the deliveries accumulated on the collection base from an opposite direction of the accumulating direction, the accumulation paddle being arranged from above the collection base so that evacuation is possible;

the accommodation box which is arranged below the collection base, and is capable of accommodating a plurality of the deliveries;

a first guide arranged on a rear surface side of the collection base to slidably contact with the delivery;

a first hinge for rotating the collection base to an away position from the accommodation box to convey the plurality of deliveries to the accommodation box directly; and a second guide arranged on the rear surface side of the collection base, the second guide being rotatable around a second hinge in a standing state on the first guide at an upstream side from the first guide in the accumulating direction.

2. The apparatus of claim 1, further comprising:

a rotation axis of the second guide is tilted in a vertical direction so that as the rotation axis goes downward the rotation axis gradually goes from an outside toward an inside of the accommodation box, in a state in which the collection base is rotated and thereby is evacuated from above the accommodation box.

3. The apparatus of claim 1, wherein the second guide is held in a state to be in approximately parallel with the collection base and rotatably around the second hinge.

4. A delivery accumulating apparatus comprising:

a collection base which is capable of accumulating a plurality of deliveries to be sequentially overlapped in a standing state in an accumulating direction on a surface thereof, the collection base is rotated and thereby evacuation is possible from above an accommodation box;

an accumulating paddle which is capable of supporting a plurality of the deliveries accumulated on the collection base from an opposite direction of the accumulating direction, the accumulation paddle being arranged from above the collection base so that evacuation is possible;

the accommodation box which is arranged below the collection base, and is capable of accommodating a plurality of the deliveries;

a first guide arranged on a rear surface side of the collection base to slidably contact with the delivery;

a first hinge for rotating the collection base to an away position from the accommodation box to convey the plurality of deliveries to the accommodation box directly; and a third guide arranged on the rear surface side of the collection base;

wherein the third guide is rotatable in a state in which the third guide stands on the first guide at a downstream side from the first guide in the accumulating direction and wherein the delivery comes in contact with the third guide to be decelerated and drops into the accommodation box.

5. The apparatus of claim 4, wherein the third guide is held in a state to be in approximately parallel with the collection base and rotatably around a third hinge.

6. A delivery accumulating apparatus comprising:

a collection base which is capable of accumulating a plurality of deliveries to be sequentially overlapped in a standing state in an accumulating direction on a surface thereof, the collection base is rotated and thereby evacuation is possible from above an accommodation box;

an accumulating paddle which is capable of supporting a plurality of the deliveries accumulated on the collection base from an opposite direction of the accumulating direction, the accumulation paddle being arranged from above the collection base so that evacuation is possible;

the accommodation box which is arranged below the collection base, and is capable of accommodating a plurality of the deliveries;

a first guide arranged on a rear surface side of the collection base to slidably contact with the delivery; and a first hinge for rotating the collection base to an away position from the accommodation box to convey the plurality of deliveries to the accommodation box directly;

wherein the collection base is rotatable beyond 90°, and the first guide is held in a state in which as the first guide goes downward, the first guide gradually extends from an outside toward an inside of the accommodation box, in a front view seen from an opposite direction of the accumulating direction.

7. A delivery accumulating apparatus comprising:

a collection base which is capable of accumulating a plurality of deliveries to be sequentially overlapped in a standing state in an accumulating direction on a surface thereof, the collection base is rotated and thereby evacuation is possible from above an accommodation box;

an accumulating paddle which is capable of supporting a plurality of the deliveries accumulated on the collection base from an opposite direction of the accumulating direction, the accumulation paddle being arranged from above the collection base so that evacuation is possible;

the accommodation box which is arranged below the collection base, and is capable of accommodating a plurality of the deliveries;

a first guide arranged on a rear surface side of the collection base to slidably contact with the delivery;

a first hinge for rotating the collection base to an away position from the accommodation box to convey the plurality of deliveries to the accommodation box directly, wherein the first guide is formed integrally with the collection base.

8. A delivery accumulating apparatus comprising:

a collection base which is capable of accumulating a plurality of deliveries to be sequentially overlapped in a standing state;

an accumulating paddle which supports a plurality of the deliveries accumulated on the collection base;

an accommodation box which is arranged below the collection base, and is capable of accommodating a plurality of the deliveries;

a first guide which slidably contacts with the delivery is arranged above the accommodation box; and a second guide which slidably contacts with the delivery, and guides the delivery to the first guide is arranged above the accommodation box, the second guide is rotatable around a second hinge, wherein the collection base can be evacuated from above the accommodation box, and wherein a third guide provided at a downstream side from the first guide in the accumulating direction, and the delivery comes in contact with the third guide to be decelerated and drops into the accommodation box.

9. The apparatus of claim 8, wherein the third guide is held in a state so as not to block the collection base is evacuated from above the accommodation box.

10. A delivery accumulating apparatus comprising:

a collection base which is capable of accumulating a plurality of deliveries to be sequentially overlapped in a standing state;

an accumulating paddle which supports a plurality of the deliveries accumulated on the collection base;

an accommodation box which is arranged below the collection base, and is capable of accommodating a plurality of the deliveries; and a first guide which slidably contacts with the delivery is arranged above the accommodation box, wherein the collection base can be evacuated from above the accommodation box, and wherein the first guide is formed integrally with the collection base.

* * * * *